US006889827B2

(12) United States Patent
Stringfield

(10) Patent No.: US 6,889,827 B2
(45) Date of Patent: May 10, 2005

(54) RESEALABLE CIGARETTE PACKAGE

(76) Inventor: Don Stringfield, 103 Lakeridge La., Macon, GA (US) 31211

( * ) Notice: Subject to any disclaimer, the term of this patent is extended or adjusted under 35 U.S.C. 154(b) by 193 days.

(21) Appl. No.: 10/218,075

(22) Filed: Aug. 13, 2002

(65) Prior Publication Data

US 2004/0031706 A1 Feb. 19, 2004

(51) Int. Cl.[7] ..... A24F 15/00
(52) U.S. Cl. ..... 206/268; 206/271
(58) Field of Search ..... 206/242, 268, 206/271, 272; 229/131.1, 149, 152, 141, 242

(56) References Cited

U.S. PATENT DOCUMENTS

| | | | | |
|---|---|---|---|---|
| 183,466 | A | | 10/1876 | Pearl |
| 348,924 | A | | 9/1886 | Munson |
| 1,822,512 | A | | 9/1931 | Tanner |
| 2,059,382 | A | | 11/1936 | Maten et al. |
| 2,107,042 | A | | 2/1938 | MacMillan, Jr. |
| 2,109,100 | A | | 2/1938 | Brophy |
| 2,199,204 | A | * | 4/1940 | Levkoff ..... 229/152 |
| 2,202,281 | A | | 5/1940 | Wilson |
| 2,445,001 | A | | 7/1948 | Pence |
| 2,944,726 | A | | 7/1960 | McCauley |
| 3,105,591 | A | | 10/1963 | Ahlbor |
| 3,167,238 | A | * | 1/1965 | Smith ..... 229/207 |
| 3,204,852 | A | | 9/1965 | Capucio |
| 3,245,525 | A | | 4/1966 | Shoemaker |
| 3,899,125 | A | | 8/1975 | Andrews et al. |
| 4,062,486 | A | * | 12/1977 | Goodrich ..... 229/223 |
| 4,372,443 | A | | 2/1983 | Woo Seop |
| 4,570,790 | A | | 2/1986 | Turnage |
| 4,948,038 | A | * | 8/1990 | Moeller ..... 229/146 |
| D311,493 | S | * | 10/1990 | Boone ..... D9/416 |
| 5,184,725 | A | | 2/1993 | Reinheimer et al. |
| 5,301,804 | A | | 4/1994 | Focke et al. |
| 5,358,105 | A | | 10/1994 | Boriani et al. |
| 5,366,077 | A | | 11/1994 | Pham |
| 5,511,658 | A | | 4/1996 | Focke et al. |
| 5,957,280 | A | | 9/1999 | Focke et al. |
| 5,964,345 | A | | 10/1999 | Gamberini |

* cited by examiner

*Primary Examiner*—David T. Fidei
(74) *Attorney, Agent, or Firm*—Charles I. Sherman; Middleton & Reutlinger

(57) ABSTRACT

A resealable hard box cigarette pack is provided with a window type opening extending across a portion of the pack top wall and also a portion of the front wall of the pack. The window is covered by a closure that may be resealed to the pack body either through insertion of a tab on the closure into a tab receiving slot in the front wall of the pack or by applying a permanent package adhesion along the outer edges of the closure with the edges of the openings in the top wall and the front wall.

7 Claims, 3 Drawing Sheets

RESEALABLE CIGARETTE PACKAGE

BACKGROUND OF THE INVENTION

This invention relates to a cigarette package having an improved closure and more particularly to a closure for a cigarette package which is resealable.

Cigarettes are packaged for sale in rigid paper boxes and non-rigid paper containers referred to as "soft packs" wherein the cigarettes are packed quite tightly therein. Cigarette packages are generally provided with closures to provide access to the tightly packed cigarettes. However, many of these closures are hard to operate and the closures are not resealable after the initial opening of the pack. In many instances, closures or flaps covering the opening into the packages are torn off by the user because they interfere with the removal of cigarettes from the package.

U.S. Pat. No. 2,107,042 teaches a cigarette package having a flip open top wherein a portion of the front wall and the entirety of the top wall is exposed upon opening. In this design the entire front wall must be lifted and moved away from the package in order to expose the package contents.

U.S. Pat. No. 2,109,100 teaches a cigarette soft-pack wherein the top flaps are unfoldable in order to expose the package contents. As is shown in FIG. 1, a small rectangular area of the package top wall is exposed along with the various fold areas of the top wall of the package. The top wall is additionally removably sealed to the front wall for repeated opening and closing. However, as is shown in FIG. 1, the top wall must be unfolded thereby exposing the left and right triangular folds constituting the top wall. Such design thereby weakens the top wall potentially allowing the entire top wall area to open and allow the contents of the package to be inadvertently dispensed.

U.S. Pat. No. 2,445,001 teaches a cigarette hard box having a resealable top opening. As is shown in FIG. 2, the top opening is exposed by removal of the entire top wall surface. Below this top wall surface is a circular opening exposing the contents of the cigarette hard box. Again the top wall is resealable with the cigarette box but requires the entire top wall to be moved away from the opening. Such a design weakens the top wall structure thereby exposing the side flaps which support the remaining top wall surface.

U.S. Pat. No. 2,944,796 teaches that one end of the top wall is hinged to expose either the left or right half of the cigarette contents. Thus, the entire half of the top wall is removable for access to the package contents.

U.S. Pat. No. 5,301,804 teaches a soft cut pack for cigarettes having a resealable top flap. The top flap also contains both left and right triangular areas which constitute a portion of the top wall thereby removing a large triangular section of the top wall and showing contents therein. The top flap of the reference is resealable to the soft cut pack. The soft cut pack also has a lift out strip 47 for raising the front cigarettes for easy removal. This is shown in FIG. 4.

SUMMARY OF THE INVENTION

It is an object of the present invention to provide a hard box package for cigarettes having a resealable closure.

It is another object of the present invention to provide a hard box package having a window-type opening extending across a portion of the pack front and up and over the package top for easy access to the contents therein.

It is a further object of the present invention to provide a cigarette package having a window-type opening extending across a portion of the pack front wherein the window is covered by a flap that can be resealed to the pack body.

It is an additional object of the present invention to provide a cigarette hard box pack including a closure having a tab insertable into the pack body for resealing of the package.

More particularly, the present invention is directed to a cigarette package which includes a front wall having a rectangular opening therein extending downwardly from a top edge of the front wall and a top wall having a rectangular opening therein extending rearwardly from a front edge in alignment with the rectangular opening in the front wall. The top wall is provided with planar surfaces on opposite sides of said opening in the top wall. A closure is hingedly attached along a rear edge of the opening in the top wall and extends forwardly and downwardly over the top wall opening and the front wall opening and is either engagable with a tab receiving slot in the front wall, or is receivably adhered to the front wall.

Additional objects, features, and advantages of the present invention will become obvious to one skilled in the art upon consideration of the following detailed description of preferred embodiments exemplifying the best modes of carrying out the invention as presently perceived. A detailed description particularly refers to the accompanying figures in which:

DETAILED DESCRIPTION OF THE PREFERRED EMBODIMENT

Figure 1:
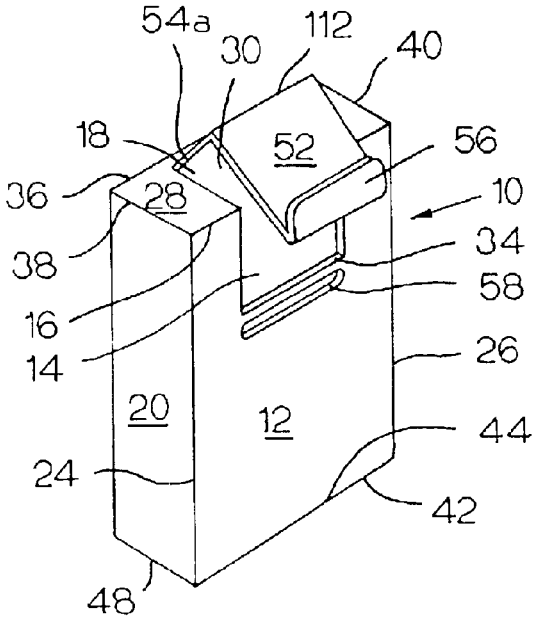
FIG. 1 is a perspective view of a first preferred embodiment of the present invention.
Figure 2:
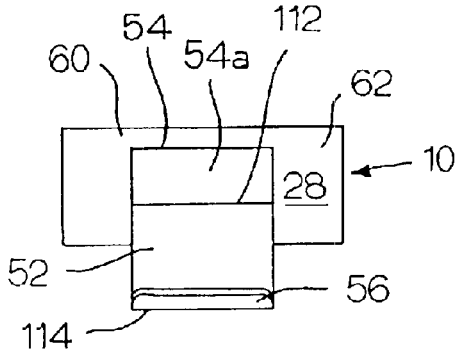
FIG. 2 is a top view of the embodiment of FIG. 1.
Figure 3:
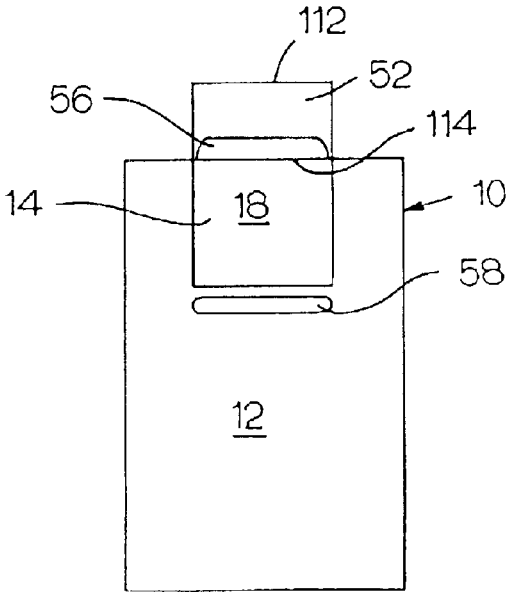
FIG. 3 is a front view of the embodiment of FIG. 1.
Figure 4:
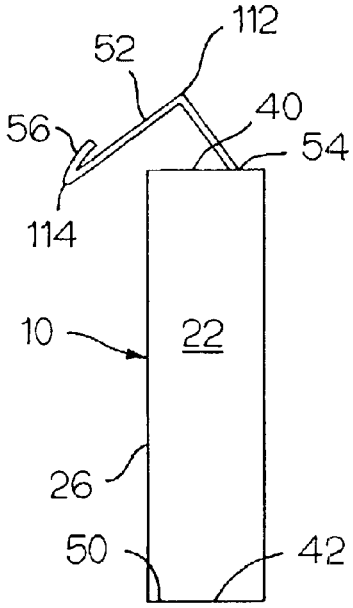
FIG. 4 is a side view of the embodiment of FIG. 1.

Shown in FIGS. 1–4 is one preferred embodiment of a cigarette package 10 of the present invention. The cigarette package 10 is made up of a front wall 12, a back wall 18, two opposed side walls 20 and 22, a top wall 28, and a bottom wall 42. The front wall 12 is provided with a front rectangular opening 14 therein which extends downwardly from a top edge 16 of the front wall 12. The opposed side walls 20 and 22 are attached along opposed sides 24 and 26 of front wall 12 extending rearwardly to the back wall 18. The top wall 28 is provided with a top rectangular opening 30 therein which extends rearwardly from the top edge 16 of the front wall 12, the top wall 28 being attached to the top edge 16 of the front wall, the top edge 36 of the back wall, and the top edges 38 and 40 of the two opposed side walls 20 and 22. The top rectangular opening 30 is in alignment with the front rectangular opening 14 in the front wall 12. The top wall 28 is also provided with two planar surfaces 60 and 62 on opposite sides of the opening 30. The bottom wall 42 is attached to bottom edges 44, 46 and 50 of the front wall 12 and the two opposed side walls 24 and 26 as well as the bottom edge of the back wall (not shown).

A closure 52 is hingedly attached along a rear edge 54 of the top opening 30. The closure 52 extends forwardly and downwardly over the top opening 30 and the front opening 14. The closure 52 is provided with a fold line 112 which is in alignment with the top edge 16 of the front wall when in a closed condition. The closure 52 is also provided with a tab 56 which is engagable with a slot 58 in the front wall 12. In the first preferred embodiment the closure 52 is provided with a top section 54*a* which extends rearwardly less than the width of the top wall 28 and includes the terminating edge 54 which is parallel to and spaced from the back wall top edge 36.

Figure 5:
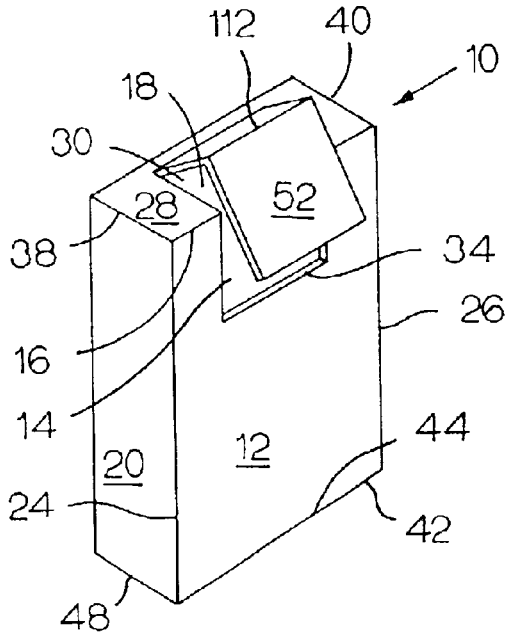
FIG. 5 is a perspective view of a second embodiment of the present invention.
Figure 6:
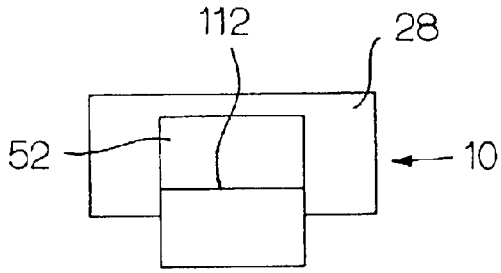
FIG. 6 is a top view of the embodiment of FIG. 5.
Figure 7:
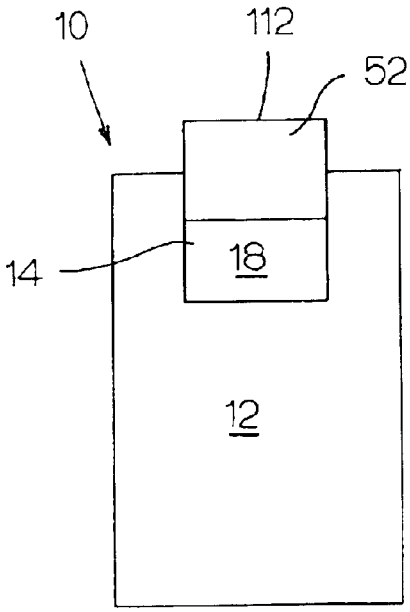
FIG. 7 is a front view of the embodiment of FIG. 5.
Figure 8:
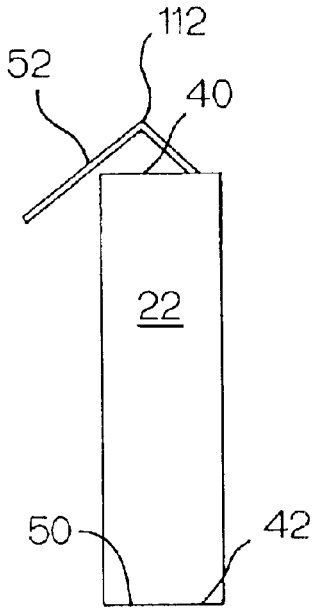
FIG. 8 is a side view of the embodiment of FIG. 5.

A second preferred embodiment is shown in FIGS. 5–8 and includes all of the same structure as the embodiment shown in FIGS. 1–4 with the exception that instead of a tab 56 being engagable with a tab receiving slot 58, the outer peripheral edges of the closure 52 are provided with an adhering material which is adherable to the outer peripheral edges of the front wall opening 14 and the top wall opening 30.

Figure 9:
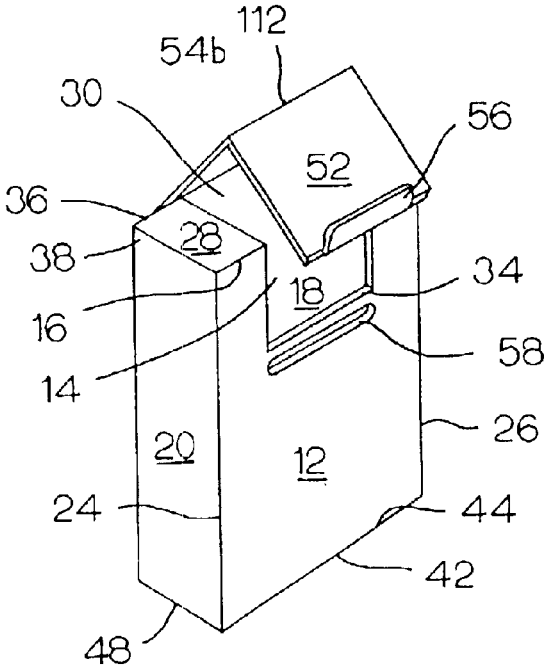
FIG. 9 is a perspective view of a third embodiment of the present invention.
Figure 10:
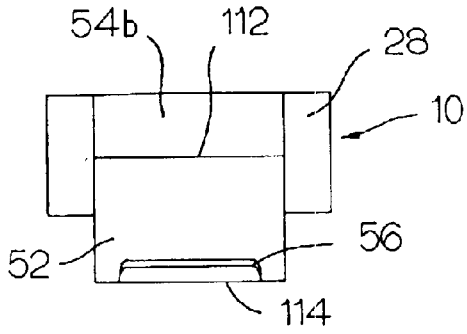
FIG. 10 is a top view of the embodiment of FIG. 9.
Figure 11:
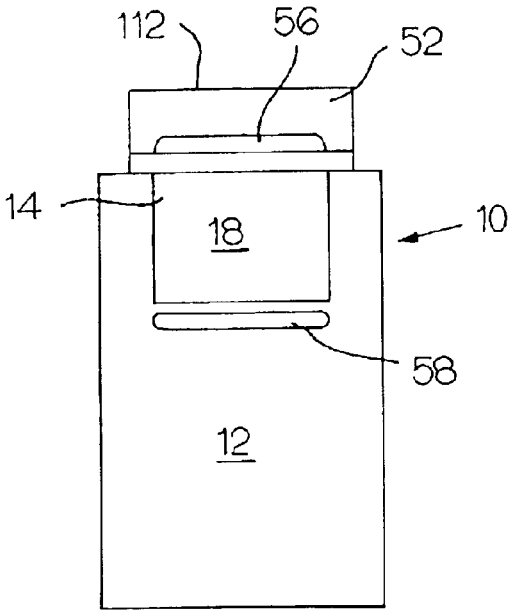
FIG. 11 is a front view of the embodiment of FIG. 9.
Figure 12:
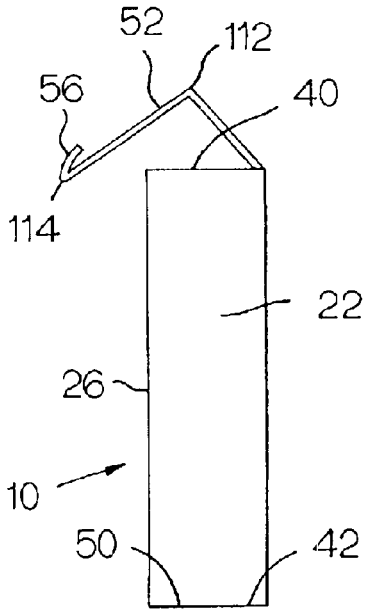
FIG. 12 is a side view of the embodiment of FIG. 9.

A third preferred embodiment is shown in FIGS. 9–12 which is similar in structure to the first embodiment as shown and described in FIGS. 1–4, with the exception that the closure 52 is provided with a top closure section 54*b* which has a back edge in alignment with the back wall top edge 36.

Although the invention has been described in detail with reference to preferred embodiments, variations and modifications exist within the scope and spirit of the invention as described and defined in the following claims:

What is claimed is:

1. A cigarette package comprising:

a front wall having a front rectangular opening therein extending downwardly from a first top edge;

a back wall;

two opposed side walls attached to opposed sides of said front wall and said back wall;

a top wall having two planar surfaces with atop rectangular opening disposed therebetween, said top rectangular opening extending rearwardly from said top edge and in alignment with said front rectangular opening, said top wall attached to said first top edge of said front wall a second top edge of said back wall, and third and fourth top edges of said two opposed side walls;

a bottom wall attached to bottom edges of said front wall, said back walls and said two opposed side walls defining a cigarette package capable of holding cigarettes therein;

a closure having a bottom edge hingedly attached along a rear edge of said top opening and extending forwardly and downwardly over said top opening and said front opening; and an outwardly extending tab along said closure bottom edge engagable with a tab receiving slot in said front wall.

2. The cigarette package of claim 1, said closure having a fold at the top edge of said front wail.

3. The cigarette package of claim 1, said rear edge being at said top edge of said back wall.

4. The cigarette package of claim 1, said rear edge being a preselected distance from said top edge of said back wall.

5. A cigarette package comprising:

a front wall having a front rectangular opening therein extending downwardly from atop edge and having a receiving slot below said front rectangular opening;

a back wall having a top edge;

two opposed side walls attached to opposed sides of said front wall and said back wall;

a bottom wall attached to bottom edges of said front wall, said back wall, and said two opposed side walls defining a cigarette package capable of holding cigarettes therein;

a top wall having a top rectangular opening therein extending from said front wall opening toward said back wall; and a closure hingedly attached along a rear edge of said top rectangular opening and extending forwardly and downwardly over said top opening and said front opening and having a bottom edge below said front opening wherein said bottom edge has an outwardly extending tab along said closure bottom edge engagable with said tab receiving slot in said front wall.

6. The cigarette package of claim 5, wherein said rear edge of said top rectangular opening being at said top edge of said back wall.

7. The cigarette package of claim 5, wherein said rear edge of said top rectangular opening being a preselected distance from said top edge of said back wall.

* * * * *